US006053952A

United States Patent [19]

Kaiser

[11] Patent Number: 6,053,952

[45] Date of Patent: Apr. 25, 2000

[54] METHOD OF DRY CLEANING USING A HIGHLY FLUORINATED ORGANIC LIQUID

[75] Inventor: Robert Kaiser, Winchester, Mass.

[73] Assignee: Entropic Systems, Inc., Winchester, Mass.

[21] Appl. No.: 09/145,876

[22] Filed: Sep. 3, 1998

[51] Int. Cl.[7] ..... D06L 1/04

[52] U.S. Cl. ..... 8/142; 510/285; 510/288; 510/290; 510/408; 510/412

[58] Field of Search ..... 8/142; 510/288, 510/290, 285, 342, 408, 412, 415

[56] References Cited

U.S. PATENT DOCUMENTS

| | | | |
|---|---|---|---|
| 3,042,479 | 7/1962 | Lawrence et al. | 8/142 |
| 3,238,011 | 3/1966 | Lawrence et al. | 8/142 |
| 3,349,038 | 10/1967 | Renault | 510/290 |
| 3,562,168 | 2/1971 | Wetmore et al. | 510/288 |
| 4,097,397 | 6/1978 | Mizutani et al. | 510/289 |
| 4,102,824 | 7/1978 | Mizutani et al. | 510/289 |
| 4,267,077 | 5/1981 | Niimi et al. | 510/287 |
| 4,401,584 | 8/1983 | Tajkowski et al. | 252/194 |
| 4,620,946 | 11/1986 | Bargigia et al. | 510/426 |
| 5,116,526 | 5/1992 | Magid et al. | 510/285 |
| 5,158,617 | 10/1992 | Li | 134/40 |
| 5,194,170 | 3/1993 | Merchant et al. | 510/408 |
| 5,196,137 | 3/1993 | Merchant | 510/408 |
| 5,302,313 | 4/1994 | Asano et al. | 510/412 |
| 5,316,690 | 5/1994 | Li | 8/142 |
| 5,399,281 | 3/1995 | Buchwald et al. | 510/290 |
| 5,478,492 | 12/1995 | Bartelemy et al. | 510/408 |
| 5,610,128 | 3/1997 | Zyhowski et al. | 510/288 |
| 5,759,986 | 6/1998 | Merchant et al. | 510/410 |
| 5,762,817 | 6/1998 | Merchant et al. | 252/67 |
| 5,827,812 | 10/1998 | Flynn et al. | 510/285 |
| 5,856,286 | 1/1999 | Nalwejek et al. | 510/288 |
| 5,891,363 | 4/1999 | Behr et al. | 510/285 |
| 5,925,611 | 6/1999 | Flynn et al. | 510/412 |

FOREIGN PATENT DOCUMENTS

| | | | |
|---|---|---|---|
| 2234269 | 1/1973 | Germany . | |
| 2603802 | 8/1977 | Germany | D06L 1/04 |
| 44009466 | 5/1969 | Japan . | |
| 105427 | 4/1984 | Japan | C11D 7/50 |
| 01139862 | 6/1989 | Japan | D06L 1/02 |
| 04323299 | 11/1992 | Japan | C11D 10/02 |
| 05043900 | 2/1993 | Japan | C11D 17/06 |
| 6-240299 | 8/1994 | Japan . | |

OTHER PUBLICATIONS

Abstract of JP 10–36894, Mitsui–DuPont–Mitsui Fluorochemicals Co, Ltd, Feb. 1998.

Abstract of JP 6–017093, Mitsui DuPont Fluorochemical, Jan. 1994.

Abstract of JP 6–341054, Mitsubishi Heavy Ind. Ltd., Dec. 1994.

Abstract of JP 10–018176, Hakuyosha K.K., Jan. 1998.

Abstract of JP 9–111653, Hakuyosha K.K., Apr. 1997.

English language translation of JP 6–240,299, Daikin Ind, pp. 1–28, Aug. 1994.

*Primary Examiner*—Caroline D. Liott

*Attorney, Agent, or Firm*—Cesari & McKenna

[57] ABSTRACT

The invention provides dry cleaning liquid formulations and methods for their use based on a highly fluorinated organic solvent which contains at least one hydrogen atom per molecule, in particular, highly fluorinated hydrocarbons or highly fluorinated ethers. In a preferred embodiment the cleaning liquid contains an HFC or HFE in combination with dichloroethylene. The addition of a surfactant enhances the ability of the liquid to remove water-soluble soils.

31 Claims, No Drawings

METHOD OF DRY CLEANING USING A HIGHLY FLUORINATED ORGANIC LIQUID

BACKGROUND OF THE INVENTION

The probability of radioactive contamination complicates the cleaning of articles used in the nuclear industry, for example, textile pieces such as protective garments, rugs and mops; soft goods such as rubber overshoes and gloves; and piece parts such as tools and machinery components. Techniques available for cleaning such articles have been circumscribed by regulatory considerations. For example, soiled garments from nuclear plants must typically be washed by a laundry specially equipped to handle fabrics contaminated with radioactive material. Operation of such a laundering facility on site is complicated by the special equipment and oversight requirements associated with the resulting effluent; consequently, such garments usually are transported to one of a few properly licensed commercial laundries. This approach is costly to the nuclear plants both due to shipping expenses and because the requisite transit time reduces the effective inventory of garments.

An alternative is a mobile dry-cleaning facility. However, in general, dry cleaning formulations contain ingredients that are classified as hazardous waste by the Environmental Protection Agency, particularly as defined by 40 C. F. R. § 261.31. For example, perchloroethylene, which is named in § 261.31, has been the dry cleaning solvent of choice in standard commercial practice. Thus applying a conventional dry-cleaning technique to a nuclear waste would produce an effluent containing both hazardous and radioactive components. The disposal of such a "mixed" waste would be particularly problematic.

More generally, the use of perchloroethylene is becoming a serious environmental issue, and many communities are trying to ban its use. The availability of alternative, environmentally benign chemistries generally applicable to dry cleaning would be desirable.

DESCRIPTION OF THE INVENTION

Objects of the Invention

Accordingly, it is an object of the invention to provide a textile-cleaning method and composition based on a substance not classified a hazardous waste, particularly as defined according to C. F. R. § 261.31.

It is a further object of the invention to provide such a method and composition that removes hydrophobic and hydrophilic soils from textiles, soft goods, and piece parts.

Detailed Description of the Invention

The invention provides dry cleaning liquid formulations and methods for their use comprising a highly fluorinated organic solvent which contains at least one hydrogen atom per molecule. As used herein, the phrase "highly fluorinated" refers generally to a compound in which fluorine atoms constitute at least one-half of the non-carbon substituents on the carbon atoms in the molecule; or, alternatively, a compound in which the total atomic weight of the fluorine in the molecule contributes greater than 50% of the molecular weight of the compound. In particular, the formulations of the invention comprise a highly fluorinated hydrocarbon containing at least one hydrogen atom per molecule (herein designated as "HFC") or a highly fluorinated ether containing at least one hydrogen atom per molecule (herein designated as "HFE"). In a preferred embodiment the cleaning liquid contains an HFC or HFE in combination with dichloroethylene. Because none of the principal components of the dry cleaning liquid of the invention—HFCs, HFEs and dichloroethylene—is listed in § 261.31, such liquids can be applied to radioactive fabric without creating a mixed waste. Thus, the handling of the effluent produced by the cleaning method of the invention is much simplified compared to that which would be required for conventional laundering or dry-cleaning techniques.

One suitable HFC solvent—2,3 dihydroperfluoropentane or HFC-4310mee—is commercially available as Vertrel XF from DuPont, Wilmington, Del. DuPont also supplies several azeotropes of 2,3 dihydroperfluoropentane with dichloroethylene, with additions of various organic solvents. For example, Vertrel MCA+ also contains cyclopentane and 2,2 dimethylbutane. Vertrel XMT is a similar azeotrope containing methanol, a hazardous material within the framework of §261.31, albeit at low levels (less than 10%).

Methoxy-nonafluorobut ane, a HFE useful in accordance with the present invention, is commercially available as HFE 7100 from 3M Specialty Chemicals Division, St. Paul, Minn. HFE 71DE is an azeotrope of methoxyperfluorobutanes with dichloroethylene; HFE 71DA is a similar azeotrope also containing a few percent ethanol.

In a preferred embodiment, a surfactant or combination of surfactants is added to the basic HFC- or HFE-based cleaning liquid formulation. The resulting solution may form a very stable water emulsion, i.e., one capable of containing greater than 5% water by volume or having water/surfactant ratio greater than 1.5. In complement to the inherent ability of the basic cleaning liquid to remove hydrophobic stains (such as motor oil), the emulsification of water made possible by an appropriate surfactant addition enhances the capability of the cleaning liquid to remove hydrophilic soils (such as mustard or ketchup) from textiles. As used herein, the phrase "basic cleaning liquid" refers to the HFC- or HFE-containing liquid of the invention without any added surfactant.

One exemplary cleaning-liquid composition contains an isopropylamine alkyl benzene sulfonote and other surfactant ingredients in Vertrel MCA+ on a dry weight basis:

| | |
|---|---|
| isopropylamine dodecyl benzene sulfonate (available from Witco Corporation as Witconate 93-S) | 0.52% |
| dialkyl sodium succinate (available from Rhone-Poulenc as Geropon SS-0-75) | 1.05% |
| organic alkyl phosphate ester (available from Witco Corporation as Emphos PS-236) | 3.84% |

This solution has been found to be an effectual cleaner for cloth samples of cotton and cotton/dacron blend. It stably suspends water up to a water-to-surfactant ratio of about 1.8 to 1.9, or up to 10%, or greater, water by volume of solution; this water capacity is roughly twice that reported for conventional perchloroethylene-based dry-cleaning formulations.

The concentration of the individual surfactants may be varied within the scope of the invention. For example, solutions within the following concentration ranges are suitable and can suspend as much as 20% (or even more) water by weight, in the cleaning, liquid:

| | |
|---|---|
| isopropylamine dodecyl benzene sulfonate | 0.5%–0.9% |
| dialkyl sodium succinate | 0.9%–1.3% |
| organic alkyl phosphate ester | 1%–9% |
| total weight percent, dry basis | 3.0–12.0 |

Alternatively, any of these surfactants may be used individually to form the surfactant solutions of the invention.

Or, other surfactants or surfactant combinations compatible both with water and the HFC- or HFE-based cleaning liquid may be used.

Dry-cleaning liquids of the invention may be used in a conventional dry-cleaning apparatus as follows. Soiled textile materials are washed in a basic HFC- or HFE-based cleaning liquid. Next, the materials are washed in a surfactant solution comprising the surfactant combination in the cleaning liquid, which is removed. Draining and centrifugation physically remove the respective basic cleaning liquid or surfactant solution after each of these washing steps. The materials are then rinsed in the basic cleaning liquid and finally dried by application of heat and/or vacuum so as to remove by vaporization any liquid trapped in the article.

The basic cleaning liquid extracted from the dry-cleaning apparatus is recycled by filtering followed by distillation. The spent surfactant solution is filtered and used repeatedly until it is no longer effective, at which time it is distilled to separate the surfactants, which are discarded, from the basic cleaning liquid, which is reused.

The use of HFCs and HFEs has several advantages: they are not flammable and do not deplete the ozone layer or contribute significantly to global warming. They are not classified as hazardous substances and are also relatively harmless with respect to operator safety.

It will therefore be seen that the invention provides a highly advantageous approach to removal of soils from textile materials, soft goods and piece parts. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A dry cleaning liquid for removing soils from textiles, the liquid comprising a surfactant solution of surfactants dissolved in a cleaning liquid, the cleaning liquid including an azeotrope of dichloroethylene with a highly fluorinated organic solvent containing at least one hydrogen atom per molecule, the surfactants comprising an organic alkyl phosphate ester, dialkyl sodium succinate and isopropylamine alkyl benzene sulfonate, the surfactant solution being capable of emulsifying water so as to remove a hydrophilic soil.

2. The dry cleaning liquid of claim 1 wherein the highly fluorinated organic solvent is a highly fluorinated hydrocarbon.

3. The method of claim 2 wherein the highly fluorinated organic solvent comprises 2,3 dihydroperfluoropentane.

4. The dry cleaning liquid of claim 1 wherein the highly fluorinated organic solvent is a highly fluorinated ether.

5. The dry cleaning liquid of claim 1 wherein the highly fluorinated organic solvent comprises a methoxyperfluorobutane.

6. The dry cleaning liquid of claim 1 wherein the surfactants comprise

| | |
|---|---|
| isopropylamine dodecyl benzene sulfonate | 0.5%–0.9% |
| dialkyl sodium succinate | 0.9%–0.3% |
| organic alkyl phosphate ester | 1%–9% |

by total surfactant solution weight.

7. A method of removing soil from an article, the method comprising the steps of:

a. exposing the article tosa first volume of a surfactant solution of at least one surfactant dissolved in a cleaning liquid, the cleaning liquid including an azeotrope of dichloroethylene with 2,3 dihydroperfluoropentane, the at least one surfactant comprising an organic alkyl phosphate ester, the surfactant solution being capable of emulsifying water so as to remove a hydrophilic soil;

b. removing the cleaning liquid from the article; and c. drying the article.

8. The method of claim 7 wherein the surfactant solution is capable of stably suspending 5% water by volume.

9. The method of claim 7 wherein the surfactant solution is capable of stably suspending water at a water-to-surfactant ratio greater than 1.5 by weight.

10. The method of claim 7 wherein the surfactant solution is capable of stably suspending 10% water by volume.

11. A method of removing soil from an article, the method comprising the steps of:

a. exposing the article to a first volume of a surfactant solution of at least one surfactant dissolved in a cleaning liquid, the cleaning liquid including an azeotrope of dichloroethylene with 2,3 dihydrofluoropentane, the at least one surfactant comprising a dialkyl sodium succinate, the surfactant solution being capable of emulsifying water so as to remove a hydrophilic soil;

b. removing the cleaning liquid from the article; and c. drying the article.

12. The method of claim 11 wherein the surfactant solution is capable of stably suspending 5% water by volume.

13. The method of claim 11 wherein the surfactant solution is capable of stably suspending water at a water-to-surfactant ratio greater than 1.5 by weight.

14. The method of claim 11 wherein the surfactant solution is capable of stably suspending 10% water by volume.

15. A method of removing soil from an article, the method comprising the steps of:

a. exposing the article to a first volume of a surfactant solution of at least one surfactant dissolved in a cleaning liquid, the cleaning liquid including an azeotrope of dichloroethylene with 2,3 dihydrofluoropentane, the at least one surfactant comprising an isopropylamine alkyl benzene sulfonate, the surfactant solution being capable of emulsifying water so as to remove a hydrophilic soil;

b. removing the cleaning liquid from the article; and c. drying the article.

16. The method of claim 15 wherein the surfactant solution is capable of stably suspending 5% water by volume.

17. The method of claim 15 wherein the surfactant solution is capable of stably suspending water at a water-to-surfactant ratio greater than 1.5 by weight.

18. The method of claim 15 wherein the surfactant solution is capable of stably suspending 10% water by volume.

19. A method of removing soil from an article, the method comprising the steps of:

a. exposing the article to a first volume of a surfactant solution of surfactants dissolved in a cleaning liquid, the cleaning liquid including an azeotrope of dichloroethylene with a highly fluorinated organic solvent containing at least one hydrogen atom per molecule, the surfactants comprising an organic alkyl phosphate ester, a dialkyl sodium succinate and an isopropylamine alkyl benzene sulfonate, the surfactant solution being capable of emulsifying water so as to remove a hydrophilic soil;

b. removing the surfactant solution from the article; and c. drying the article.

20. The method of claim 19 wherein the surfactant solution is capable of stably suspending 10% water by volume.

21. The method of claim 19 further comprising the step of rinsing the article with a second volume of the cleaning liquid following the step of exposing the article to the surfactant solution.

22. The method of claim 19 wherein the surfactant solution is capable of stably suspending 5% water by volume.

23. The method of claim 19 wherein the cleaning liquid is capable of stably suspending water at a water-to-surfactant ratio greater than 1.5 by weight.

24. The method of claim 19 wherein the at least one surfactant comprises

| | |
|---|---|
| isopropylamine dodecyl benzene sulfonate | 0.5%–0.9% |
| dialkyl sodium succinate | 0.9%–1.3% |
| organic alkyl phosphate ester | 1%–9% |

by total surfactant solution weight.

25. The method of claim 19 wherein the highly fluorinated organic solvent is a highly fluorinated hydrocarbon.

26. The method of claim 25 wherein the highly fluorinated organic solvent comprises 2,3 dihydroperfluoropentane.

27. The method of claim 19 wherein the highly fluorinated organic solvent is a highly fluorinated ether.

28. The method of claim 27 wherein the highly fluorinated organic solvent comprises a methoxyperfluorobutane.

29. The method of claim 26 wherein the surfactant solution comprises

| | |
|---|---|
| isopropylamine dodecyl benzene sulfonate | 0.5%–0.9% |
| dialkyl sodium succinate | 0.9%–1.3% |
| organic alkyl phosphate ester | 1%–9% |

by total surfactant solution weight.

30. The method of claim 29 wherein the surfactant solution is capable of stably suspending 20% water by weight.

31. The method of claim 26 wherein the cleaning liquid further comprises cyclopentane and 2,2 dimethylbutane.

* * * * *